US011345509B2

(12) United States Patent
Xu et al.

(10) Patent No.: US 11,345,509 B2
(45) Date of Patent: May 31, 2022

(54) BOX DIVIDER SYSTEM

(71) Applicant: IdeaStream Consumer Products, LLC, Cleveland, OH (US)

(72) Inventors: Youfang Xu, Shenzhen (CN); Jensen Tuen, Fenling (HK); Daniel Perella, Hudson, OH (US); Benjamin Hietanen, Mentor, OH (US); Ashlee Hientanen, Mentor, OH (US); Zhenghong Li, Shenzhen (CN); Ziyu Duan, Zenshen (CN)

(73) Assignee: IDEASTREAM CONSUMER PRODUCTS, LLC, Cleveland, OH (US)

( * ) Notice: Subject to any disclaimer, the term of this patent is extended or adjusted under 35 U.S.C. 154(b) by 117 days.

(21) Appl. No.: 16/682,030

(22) Filed: Nov. 13, 2019

(65) Prior Publication Data

US 2020/0189789 A1 Jun. 18, 2020

Related U.S. Application Data

(60) Provisional application No. 62/778,599, filed on Dec. 12, 2018.

(51) Int. Cl.

| | |
|---|---|
| ***B65D 5/49*** | (2006.01) |
| ***B65D 25/06*** | (2006.01) |
| ***B31D 5/00*** | (2017.01) |

(52) U.S. Cl.

CPC ..... *B65D 5/48046* (2013.01); *B31D 5/0013* (2013.01); *B65D 25/06* (2013.01)

(58) Field of Classification Search

CPC ..... B65D 5/48006; B65D 5/48046; B65D 5/48036; B65D 5/48; B65D 7/065; B65D 25/04; B65D 71/0022; B65D 85/328

See application file for complete search history.

(56) References Cited

U.S. PATENT DOCUMENTS

| | | | | |
|---|---|---|---|---|
| 2,140,001 | A | | 12/1938 | Davitt |
| 3,227,504 | A | * | 1/1966 | Dunham ..... B42F 17/02 312/234.4 |
| 4,372,444 | A | * | 2/1983 | Le Grand ..... B65D 25/06 206/505 |
| 4,499,997 | A | * | 2/1985 | Swingley, Jr. ..... B65D 21/0219 206/427 |
| 5,148,942 | A | | 9/1992 | Snook |
| 5,299,688 | A | * | 4/1994 | McKay ..... B42F 17/02 206/425 |
| D461,126 | S | | 8/2002 | Decello et al. |
| 6,945,293 | B1 | | 9/2005 | Newton |
| 7,004,323 | B1 | | 2/2006 | Symonds |
| D701,047 | S | | 3/2014 | Sanchez |
| D702,944 | S | | 4/2014 | Sanchez |

(Continued)

*Primary Examiner* — Andrew T Kirsch
(74) *Attorney, Agent, or Firm* — Ulmer & Berne LLP; Brian E. Turung

(57) ABSTRACT

The present disclosure relates to compartment system for storing and organizing various items and objects. The compartment system includes an exemplary divider which fits within pre-existing boxes and separates the same into various storage compartments. The divider is generally made of one or more sidewalls, one or more transverse divider walls, and optionally one or more axial divider walls. Methods of forming the exemplary dividers are also disclosed.

16 Claims, 11 Drawing Sheets

(56) References Cited

U.S. PATENT DOCUMENTS

| | | | |
|---|---|---|---|
| D712,153 | S | 9/2014 | Lee |
| D878,764 | S | 3/2020 | Hietanen et al. |
| D884,350 | S | 5/2020 | Hietanen et al. |

* cited by examiner

BOX DIVIDER SYSTEM

The present disclosure claims priority on U.S. Provisional Application Ser. No. 62/778,559 filed Dec. 12, 2018, which is incorporated herein by reference.

The present disclosure relates to compartment systems for storing and organizing various items and objects, and more particularly to dividers configured to fit within pre-existing boxes and separate the same into various storage compartments.

BACKGROUND

A variety of devices for storing and organizing various objects exist in the marketplace today. Two-piece lid and container products are typically presented to consumers as a device specialized in the storing and organizing of objects. Often times, consumers already possess many kinds of containers or boxes which, in lieu of having to purchase a specifically designated product, could be used to store and organize objects. These boxes may be left over from delivered packages or from prior life events, such as moving homes. However, left over or existing boxes in most consumers' possession have only a single interior region for storage or do not otherwise provide a means to organize stored items.

Divider systems are available for boxes and containers; however, many of these available dividers are not durable and result in sections of the divider disengaging when the box and container are moved.

There remains a need for a novel compartment system and divider associated therewith that provides sufficient organization to existing boxes in a wide range of sizes.

BRIEF DESCRIPTION

In accordance with one non-limiting aspect of the present disclosure, a compartment system is disclosed which includes a box, a lid, and an exemplary divider configured in accordance with the present disclosure. The divider is configured to fit within the interior area of the box and separate the interior area into a plurality of storage regions or compartments. The divider is generally made of one or more sidewalls, one or more transverse divider walls, and optionally one or more axial divider walls. The walls which make up the divider mate or interconnect to form additional storage compartments when in an assembled configuration with an associated box or container. Generally, the front and/or back face of the one or more sidewalls, one or more transverse divider walls, and the one or more axial divider walls (when used) are generally flat; however, this is not required. Generally, the body of the one or more sidewalls, one or more transverse divider walls, and the one or more axial divider walls (when used) lie in the longitudinal axis of the respective component of the divider; however, this is not required.

In accordance with another and/or alternative non-limiting aspect of the compartment system, the divider further includes one or more sidewalls, one or more transverse divider walls, and one or more axial divider walls. In one non-limiting embodiment, one or more of the sidewalls, transverse divider walls, and/or axial divider walls include at least one or more of a female connecting feature and/or a male connecting feature.

In accordance with another and/or alternative non-limiting aspect of the compartment system, one or more of the female connecting features include slots and one or more of the male connecting features include flanges.

In accordance with another and/or alternative non-limiting aspect of the compartment system, at least one of the one or more transverse divider walls further includes a floor.

In accordance with another and/or alternative non-limiting aspect of the compartment system, there is provided a method of forming a compartment system. The method includes providing a box and a lid and forming a divider from one or more sidewalls, one or more transverse divider walls, and one or more axial divider walls and, placing the divider into the box.

In accordance with another and/or alternative non-limiting aspect of the compartment system, the method of forming the divider further includes providing at least one partially complete element for each of the one or more sidewalls, one or more transverse divider walls, and one or more axial divider walls and manipulating each of the at least one partially complete elements to form the one or more sidewalls, one or more transverse divider walls, and one or more axial divider walls.

In accordance with another and/or alternative non-limiting aspect of the compartment system, there is provided a compartment system that includes a divider, a box, and an optional lid. In one non-limiting embodiment, the divider is configured to be insertable into and removable from the interior area of the box. The divider is adapted to fit within the interior area of the box, thereby separating the box into various compartments or interior regions. The optional lid is adapted to fit over the box and divider. Generally, the maximum height of the divider, when fully assembled, is less than or equal to the height of one or more of the sidewalls of the interior area of the box such that the divider does not extend above one or more of the sidewalls of the interior area of the box when the diver is placed in the interior area of the box.

In accordance with another and/or alternative non-limiting aspect of the compartment system, the divider generally includes one or more sidewalls, one or more transverse divider walls, and optionally one or more axial divider walls. At least one transverse divider wall is generally configured to engage at least two sidewalls and to facilitate in maintaining a space between the at least two sidewalls when the transverse divider wall is assembled with at least two of the sidewalls. When the compartment system includes two or more transverse divider walls, generally two or all of the transverse divider walls are configured to engage at least two sidewalls and facilitate in maintaining a space between the at least two sidewalls when the transverse divider walls are assembled with at least two of the sidewalls; however, this is not required. When one or more axial divider walls are optionally used, at least one of the axial divider walls are generally configured to engage at least two transverse dividers walls and to facilitate in maintaining a space between the at least two transverse dividers walls when the axial divider wall is assembled with at least two of the transverse divider walls. When two or more axial divider walls are optionally used, the two or more axial divider walls are generally configured to engage at least two transverse dividers walls and to facilitate in maintaining a space between the at least two transverse dividers walls when the two or more axial divider walls are assembled with at least two of the transverse divider walls; however, this is not required. In one non-limiting embodiment, one or all of the transverse divider walls are oriented generally transverse to one or more of the sidewalls when one or more of the transverse divider walls are assembled with at least two of the sidewalls; however, this is not required. In another non-limiting embodiment, one or all of the axial divider walls are oriented generally transverse to one or more of the transverse divider walls when one or more of the axial divider walls are assembled with at least two of the transverse divider walls; however, this is not required. As used herein, the term "transverse" generally means that a wall is at a right angle. In another non-limiting embodiment, all of the transverse divider walls are oriented generally transverse to the sidewalls, and all of the axial divider walls (when used) are oriented generally parallel to the sidewalls and generally transverse to the transverse divider walls; however, this is not required.

In accordance with another and/or alternative non-limiting aspect of the compartment system, the divider generally includes two or more sidewalls, two or more transverse divider walls, and optionally two or more axial divider walls, and wherein one transverse divider wall is spaced a distance TD1 from one interior side of the interior area of the box, and a second transverse divider wall is a spaced a distance TD2 from an opposite interior side of the interior area of the box when the divider is assembled and placed in the interior area of the box, and wherein distance TD1 is within ±5% of TD2, and typically TD1 is equal to TD2. In one non-limiting embodiment, TD1 and TD2 are greater than or equal to 1 inch. In another non-limiting embodiment, TD1 and/or TD2 is equal to or within ±5% of a distance between two of the transverse divider walls, and typically TD1 and/or TD2 is equal to the distance between two of the transverse divider walls.

In accordance with another and/or alternative non-limiting aspect of the compartment system, the divider generally includes two or more sidewalls, two or more transverse divider walls, and one or more axial divider walls, and wherein one axial divider is spaced a distance AD1 from one interior side of the interior area of the box, and spaced a distance AD2 from an opposite interior side of the interior area of the box when the divider is assembled and placed in the interior area of the box, and wherein distance AD1 is within ±5% of AD2, and typically AD1 is equal to AD2. In one non-limiting embodiment, AD1 and AD2 are greater than or equal to 1 inch. In another non-limiting embodiment, the divider generally includes two or more sidewalls, two or more transverse divider walls, and two or more axial divider walls, and wherein one axial divider is spaced a distance AD1 from one interior side of the interior area of the box, and a second axial divider is spaced a distance AD2 from an opposite interior side of the interior area of the box when the divider is assembled and placed in the interior area of the box, and wherein distance AD1 is within ±5% of AD2, and typically AD1 is equal to AD2. In another non-limiting embodiment, TD1 and/or TD2 is equal to or within ±5% of a distance between two of the axial divider walls, and typically TD1 and/or TD2 is equal to the distance between two of the axial divider walls.

In accordance with another and/or alternative non-limiting aspect of the compartment system, a first side wall of the divider has a longitudinal length that is at least 90% of the longitudinal length of the interior side of the interior area of the box to which the first side wall is positioned against or closely adjacent to (e.g., less than 1 in.), and typically 90-105% (and all values and ranges therebetween) of the longitudinal length of the interior side of the interior area of the box to which the first side wall is positioned against or closely adjacent to. In another non-limiting embodiment, a second side wall of the divider has a longitudinal length that is at least 90% of the longitudinal length of the interior side of the interior area of the box to which the second side wall is positioned against or closely adjacent to (e.g., less than 1 in.), and typically 90-105% (and all values and ranges therebetween) of the longitudinal length of the interior side of the interior area of the box to which the first side wall is positioned against or closely adjacent to. In another non-limiting embodiment, the first and second sidewalls of the divider are positioned generally parallel to one another with the divider is assembled and placed in the interior area of the box; however, this is not required.

In accordance with another and/or alternative non-limiting aspect of the compartment system, one or more of the sidewalls of the divider include one or more female connecting features or slots formed on an upper edge of each sidewall. The one or more female connecting features or slots are generally configured to mate with a transverse divider walls. In one non-limiting embodiment, one or more of the sidewalls of the divider include a plurality of female connecting features or slots formed on an upper edge of each sidewall. In another non-limiting embodiment, wherein one female connecting features or slots are spaced a distance from one end of the sidewall that is the same distance as a second female connecting features or slots are spaced from the opposite end of the sidewall (e.g., at least 1 in. from an end of the sidewall). In another non-limiting embodiment, one or more of the sidewalls of the divider include three or more female connecting features or slots formed on an upper edge of each sidewall and wherein a spacing between two female connecting features or slots is the same as the spacing between another two connecting features or slots. In another non-limiting embodiment, the longitudinal length of one or more of the female connecting features or slots is no more than 50% a height of the sidewall. Creating female connecting features or slots that have a height of greater than 50% the height of the sidewall can adversely affect the strength of the sidewall. In one non-limiting design, the longitudinal length of one or more of the female connecting features or slots is about 5-50% a height of the sidewall (and all values and ranges therebetween). In another non-limiting design, the longitudinal length of one or more of the female connecting features or slots is about 5-45% a height of the sidewall. In another non-limiting design, the longitudinal length of one or more of the female connecting features or slots is about 5-40% a height of the sidewall. Generally, the longitudinal length of the female connecting features or slots is the same on a sidewall. Generally, a width (measured along a longitudinal length of the sidewall) of two or more or all of the female connecting features or slots is the same on a sidewall. Generally, a thickness (measured transverse to a longitudinal axis of the sidewall) of two or more or all the female connecting features or slots is the same on a sidewall.

In accordance with another and/or alternative non-limiting aspect of the compartment system, one or more of the transverse divider walls include one or more male connecting features or flanges. The one or more male connecting features or flanges are formed on an upper portion of each side of the transverse divider walls. Each of the connecting features or flanges includes an extension portion that is connected at a first side to the side of the transverse divider wall and which extension portion extends outwardly from the side of the transverse divider wall. The width of the extension portion is generally within ±5% a thickness of the female connecting features or slots on a sidewall to which the transverse divider wall is to be connected to. The extension portion has a height (measured along a height of the transverse divider wall) that is no more than 50% a height of the transverse divider wall. In one non-limiting design, the height of the extension portion is about 5-50% a height of the transverse divider wall (and all values and ranges therebetween). In another non-limiting design, the height of the extension portion is about 5-45% a height of the transverse divider wall. In another non-limiting design, the height of the extension portion is about 5-40% a height of the transverse divider wall. In another non-limiting design, the height of the extension portion is within ±5% of the longitudinal length of the female connecting features or slots of the sidewall to which the transverse divider wall is connected thereto. Each of the connecting features or flanges includes a flange extension that is connected to the second side of the extension portion. The width of the flange extension is generally greater than a width of the extension portion. In one non-limiting configuration, the width of the flange extension is generally 1.1-50 times (and all values and ranges therebetween) the width of the extension portion (i.e., for a width of the extension portion of 0.1 in., the width of the flange extension is 0.11-5 in.). In another non-limiting configuration, the length of the flange extension is generally 2-30 times the width of the extension portion. The height of the flange extension is generally at least 5% of the height of the extension portion. In one non-limiting configuration, the height of the flange extension is 5-1000% (and all values and ranges therebetween) of the height of the extension portion. In another non-limiting configuration, the height of the flange extension is equal to the height of the extension portion. The thickness of the flange extension is generally at least 10% of the thickness of the extension portion. In one non-limiting configuration, the thickness of the flange extension is 10-500% (and all values and ranges therebetween) of the thickness of the extension portion. In another non-limiting configuration, the thickness of the flange extension is equal to the thickness of the extension portion. Prior to the full assembly of the divider, the flange extension can lie in a plane that is parallel or non-parallel to the longitudinal axis of the transverse divider wall. When the front face of the flange extension lies in a plane that is parallel to the longitudinal axis of the transverse divider wall, the flange extension is configured to be bendable at the connection location of the extension portion so that the flange extension can be bent until the front face of the flange extension is at least 60° and typically 80-110° (and all values and ranges therebetween) to the longitudinal axis of the transverse divider wall. Such bending can be facilitated by a groove, scoring, slots, etc. Alternatively, when the flange extension is not configured to be bendable relative to the transverse divider wall, the flange extension is generally oriented about 85-95° (e.g., 90°) to the longitudinal axis of the transverse divider wall.

In accordance with another and/or alternative non-limiting aspect of the compartment system, the one or more male connecting features or flanges are used to facilitate in preventing the ends of transverse divider walls from disengaging from the sidewalls. Components of prior art divider systems can commonly disengage from one another when the containers are moved, tilted, turned over, etc. Such disengagement commonly occurs due to heavy objects resting against the wall of a divider and thereby causing the divider wall to bend and disengage. Such disengagement of the divider components can result in mixing of materials in the different divider components and/or damage to one or more materials in the container. The one or more male connecting features or flanges are configured to prevent the transverse divider walls from disengaging from the sidewalls, thereby overcoming a problem with prior art dividers.

In accordance with another and/or alternative non-limiting aspect of the compartment system, one or more of the transverse divider walls optionally include one or more female connecting features or slots formed on an upper edge of one or more transverse divider walls. The one or more female connecting features or slots are generally configured to mate with an axial divider wall (when used). In another non-limiting embodiment, wherein one female connecting features or slots is spaced a distance (e.g., at least one in. from an end of the transverse divider wall) from one end of the transverse divider wall. In one non-limiting configuration, the transverse divider walls optionally include one female connecting feature or slot formed on an upper edge of one or more transverse divider walls. In one non-limiting configuration, the one female connecting feature or slot is located within ±5% from the longitudinal length midpoint. In another non-limiting configuration, the transverse divider wall optionally includes two female connecting features or slots formed on an upper edge of one or more transverse divider wall. In one non-limiting configuration, a first female connecting features or slots is spaced a distance from a side of the transverse divider wall that is the same distance as a second female connecting features or slots is spaced from the opposite end of the transverse divider wall. In another non-limiting embodiment, the longitudinal length of one or more of the female connecting features or slots is no more than 50% a height of the transverse divider wall. Creating female connecting features or slots that have a height of greater than 50% than the height of the transverse divider wall can adversely affect the strength of the transverse divider wall. In one non-limiting design, the longitudinal length of one or more of the female connecting features or slots is about 5-50% a height of the transverse divider wall (and all values and ranges therebetween). In another non-limiting design, the longitudinal length of one or more of the female connecting features or slots is about 5-45% a height of the transverse divider wall. In another non-limiting design, the longitudinal length of one or more of the female connecting features or slots is about 5-40% a height of the transverse divider wall. When the transverse divider wall includes two or more female connecting features or slots, the longitudinal length of the female connecting features or slots is the same; however, this is not required. Generally, a width (measured along a longitudinal length of the transverse divider wall) of two or more or all of the female connecting features or slots is the same on a transverse divider wall. Generally, a thickness (measured transverse to a longitudinal axis of the transverse divider wall) of two or more or all the female connecting features or slots is the same on a transverse divider wall.

In accordance with another and/or alternative non-limiting aspect of the compartment system, the one or more axial divider walls (when used) include one or more male connecting features or tabs positioned on the side end of the axial divider wall. The one or more tabs are formed on an upper portion of one or both side of the axial divider walls. The one or more tabs are generally spaced and sized to mate with a corresponding female connecting features or slots in in the transverse divider wall. The one or more tabs are configured to be positioned in a female connecting features or slots in the transverse divider wall. The width of the one or more tabs is generally equal to or greater than the thickness of the female connecting features or slots in the transverse divider wall. In one non-limiting configuration, the width of the one or more tabs is generally greater than the thickness of the female connecting features or slots in the transverse divider wall. In one non-limiting design, the width of the one or more tabs is generally 5%-50% greater (and all value and ranges therebetween) than the thickness of the female connecting features or slots in the transverse divider wall. The configuration of having the width of the tabs being a greater than the thickness of the female connecting features or slots of the transverse divider wall is to inhibit or prevent the ends of the axial divider wall from disengaging from the transverse divider wall. Such a configuration is an improvement over prior art divider systems.

In accordance with another and/or alternative non-limiting aspect of the compartment system, the one or more axial divider walls (when used) include one or more female connecting features or slots formed on a lower edge of each axial divider wall. The female connecting features or slots are generally configured to mate with a female connecting features or slots in the transverse divider wall. The longitudinal length of one or more of the female connecting features or slots on the axial divider wall is greater than 50% a height of the axial divider walls. In one non-limiting design, the longitudinal length of one or more of the female connecting features or slots is about 55-90% a height of the axial divider wall (and all values and ranges therebetween). In another non-limiting design, the longitudinal length of one or more of the female connecting features or slots is about 60-90% a height of the axial divider wall. When the axial divider wall includes two or more female connecting features or slots, the longitudinal length of the female connecting features or slots is the same; however, this is not required. Generally, a width (measured along a longitudinal length of the axial divider wall) of the female connecting features or slots is within ±5% of a thickness of the transverse divider wall to which the axial divider wall is to be connected.

In accordance with another and/or alternative non-limiting aspect of the compartment system, one or more transverse divider walls include a floor portion. The floor portion is formed on a lower edge of the transverse divider wall. When the divider is assembled and placed within the interior area of the box, the floor portion is oriented generally perpendicular to the body of the transverse divider wall. Generally, the floor portion is positioned parallel to the base of the interior area of the box, and the body of the transverse divider wall extends upwardly from the base of the interior area of the box when the divider is assembled and placed within the interior area of the box. The longitudinal length of the floor portion can be the same or less than the longitudinal length of the body of the transverse divider wall. Generally, the longitudinal length of the floor portion is 50-100% (and all values and ranges therebetween) the longitudinal length of the body of the transverse divider wall. The width of the floor portion is generally at least one inch. In one non-limiting configuration, the width of the floor portion is 50-100% (and all values and ranges therebetween) the distance the of a) the body of the transverse divider wall spaced from a side of the interior area of the box that is positioned parallel to the face of the body of the transverse divider, and/or or b) the distance the body of one transverse divider wall positioned from the body of another transverse divider wall. The use of the floor portion facilitates in maintaining the divider in the interior area of the box, and/or providing structural strength to the transverse divider wall to thereby inhibit or prevent bending of the transverse divider wall. Such a feature is another improvement over prior art divider systems. The thickness of the floor portion is generally the same or less than a thickness of the body of the transverse divider wall. Prior to the full assembly of the divider, the floor portion can lie in a plane that is parallel or non-parallel to the lateral axis of the transverse divider wall. When the front face of the floor portion lies in a plane that is parallel to the lateral axis of the transverse divider wall, the floor portion is configured to be bendable at the connection location of the floor portion so that the floor portion can be bent until the front face of the floor portion is at least 60° and typically 80-110° (and all values and ranges therebetween) to the lateral axis of the transverse divider wall. Such bending can be facilitated by a groove, scoring, slots, etc. Alternatively, when the floor portion is not configured to be bendable relative to the transverse divider wall, the floor portion is generally oriented about 85-95° (e.g., 90°) to the lateral axis of the transverse divider wall. The one or more floor portions (when used) can provide additional strength and support needed to accommodate and safely store bigger, heavier, or larger number of objects in the box or container. Also, the one or more floor portions (when used) can provide additional stability to the divider. Dividers that are configured to fit within large or oversized boxes, for example, may be more prone to flexing or shifting, compared with smaller dividers and boxes, especially during assembly of the divider itself or when various objects are being placed within a box and divider in the assembled configuration. The one or more floor portions can be configured to provide the additional stability, strength, and/or support for larger dividers and boxes and for the safe storing of various objects therein. Such floor portions provide an advantage over prior art dividers.

In accordance in another and/or alternative non-limiting aspect of the compartment system, the components of the divider can be made from any desired material, the particular material used being non-limiting (e.g., paper, cardboard, plastic, thermoplastic, polymer, rubber, metal, wood, etc.).

These and other objects and advantages will become apparent from the discussion of the distinction between the invention and the prior art and when considering the preferred embodiment shown in the accompanying drawings.

BRIEF DESCRIPTION OF THE DRAWINGS

Reference may now be made to the drawings, which illustrate various embodiments that the invention may take in physical form and in certain parts and arrangements of parts wherein.

DETAILED DESCRIPTION

Figure 1:
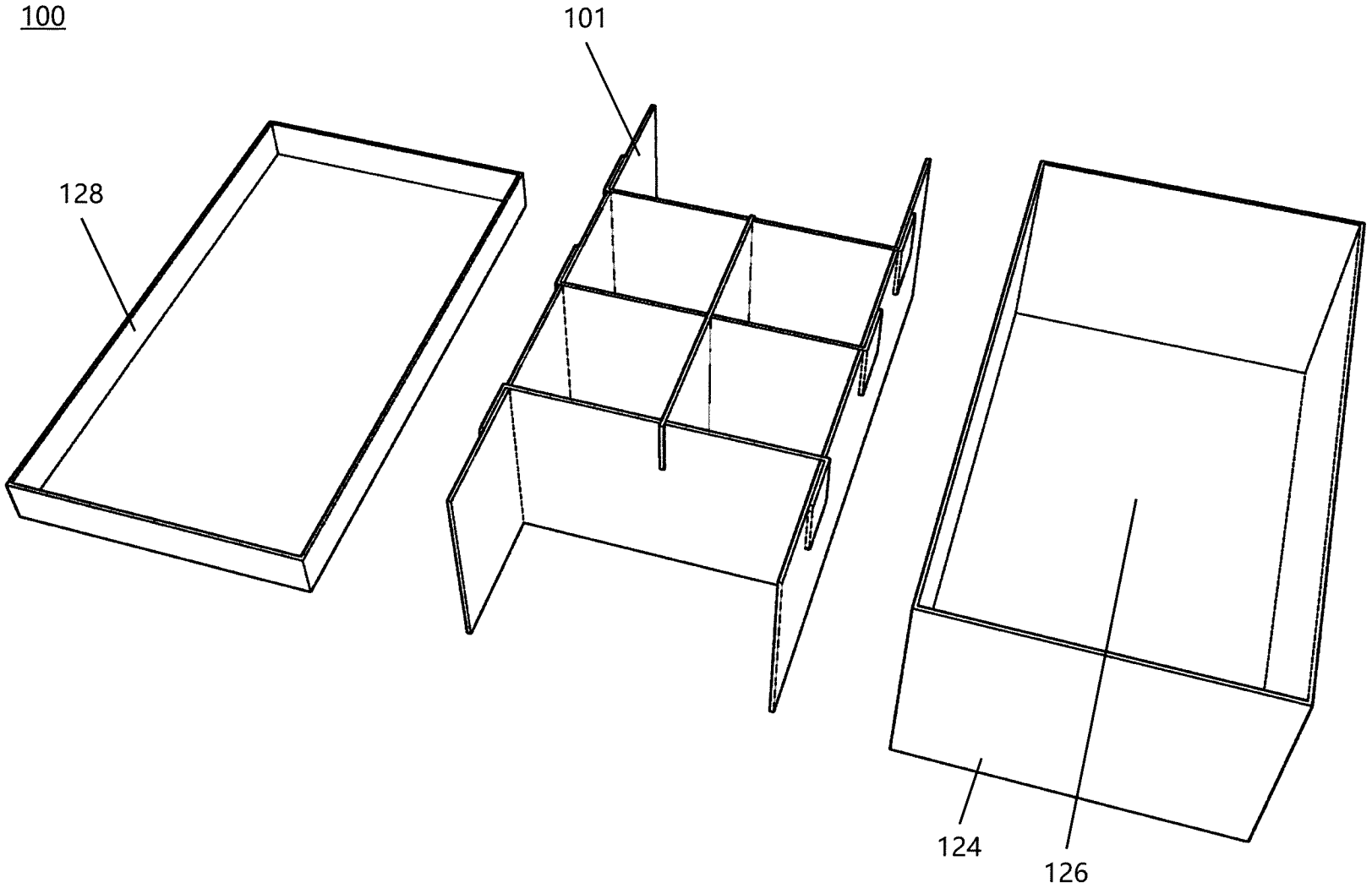
FIG. 1 is an illustration of one non-limiting aspect of the present disclosure, showing a top perspective view of an exemplary compartment system with a lid, a box, and a divider in a pre-assembled configuration according to one embodiment.

A more complete understanding of the articles/devices, processes and components disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any unavoidable impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

The terms "about" and "approximately" can be used to include any numerical value that can vary without changing the basic function of that value. When used with a range, "about" and "approximately" also disclose the range defined by the absolute values of the two endpoints, e.g. "about 2 to about 4" also discloses the range "from 2 to 4." Generally, the terms "about" and "approximately" may refer to plus or minus 10% of the indicated number.

Percentages of elements should be assumed to be percent by weight of the stated element, unless expressly stated otherwise.

Figure 8:
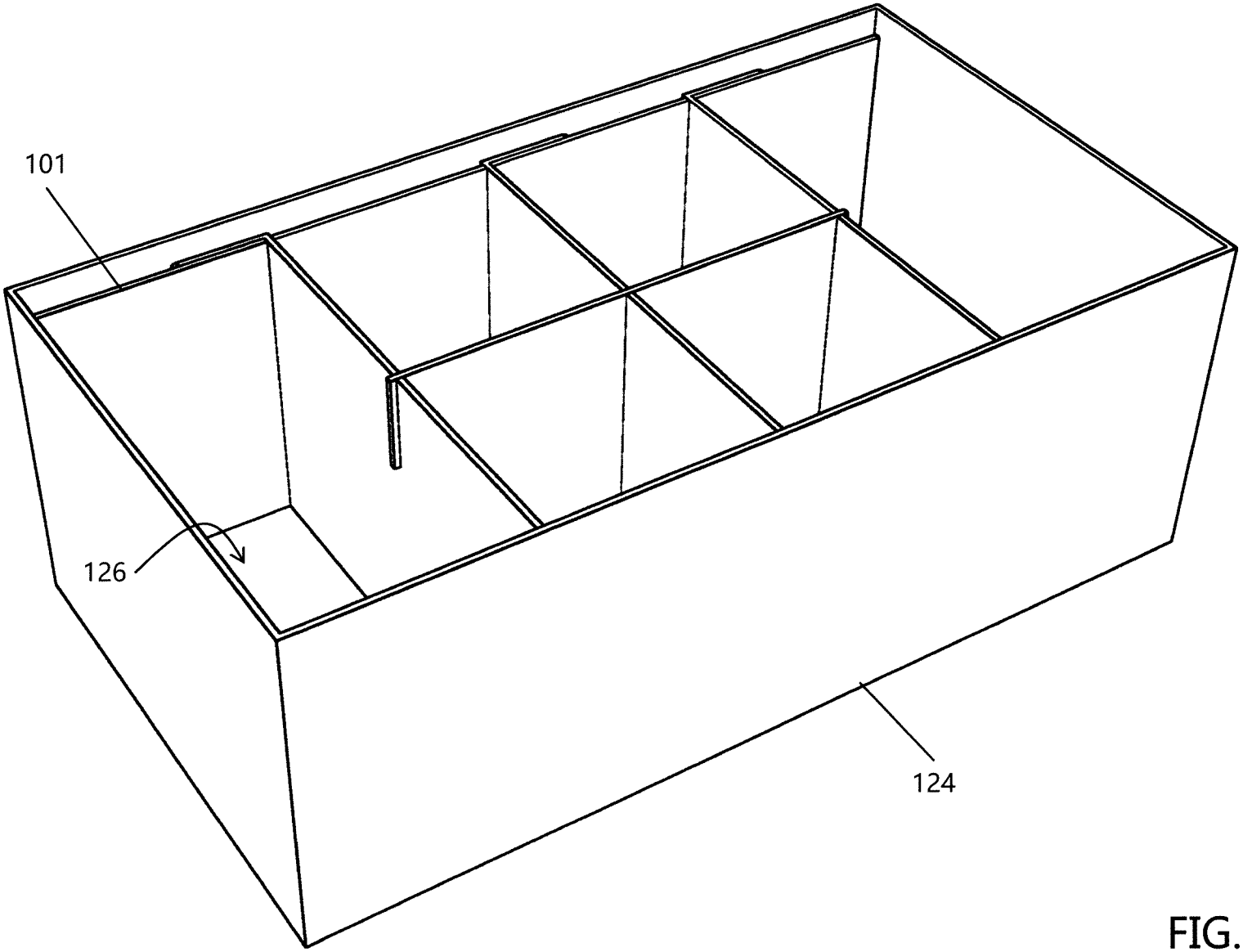
FIG. 8 is an illustration showing a top perspective view of the box and divider of FIG. 7, where the divider has been positioned within the box to form the assembled configuration.
Figure 9:
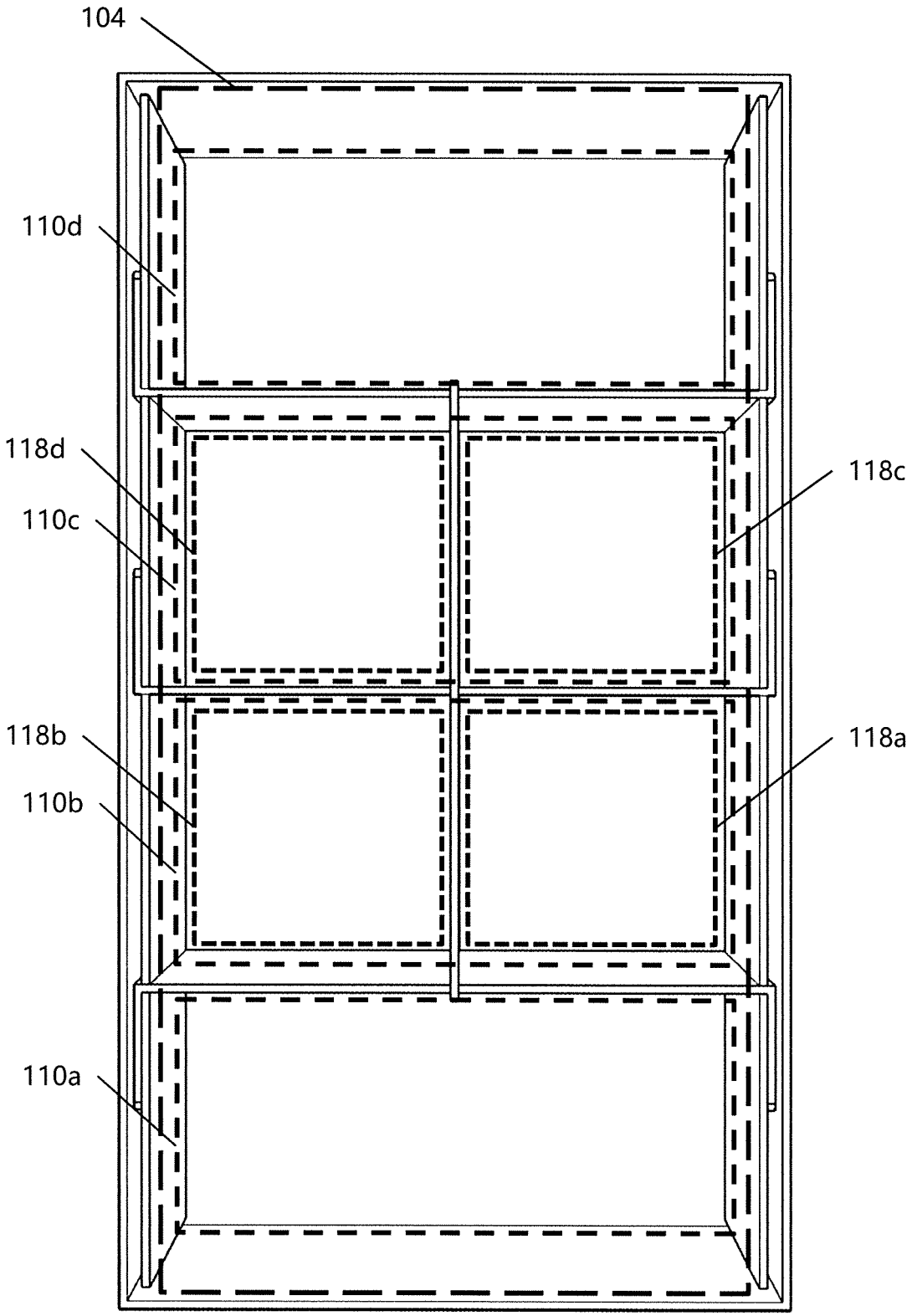
FIG. 9 is an illustration showing a top view of the assembled box and divider of FIG. 8, where the various storage compartments formed by the divider can be seen within the interior area of the box.
Figure 11:
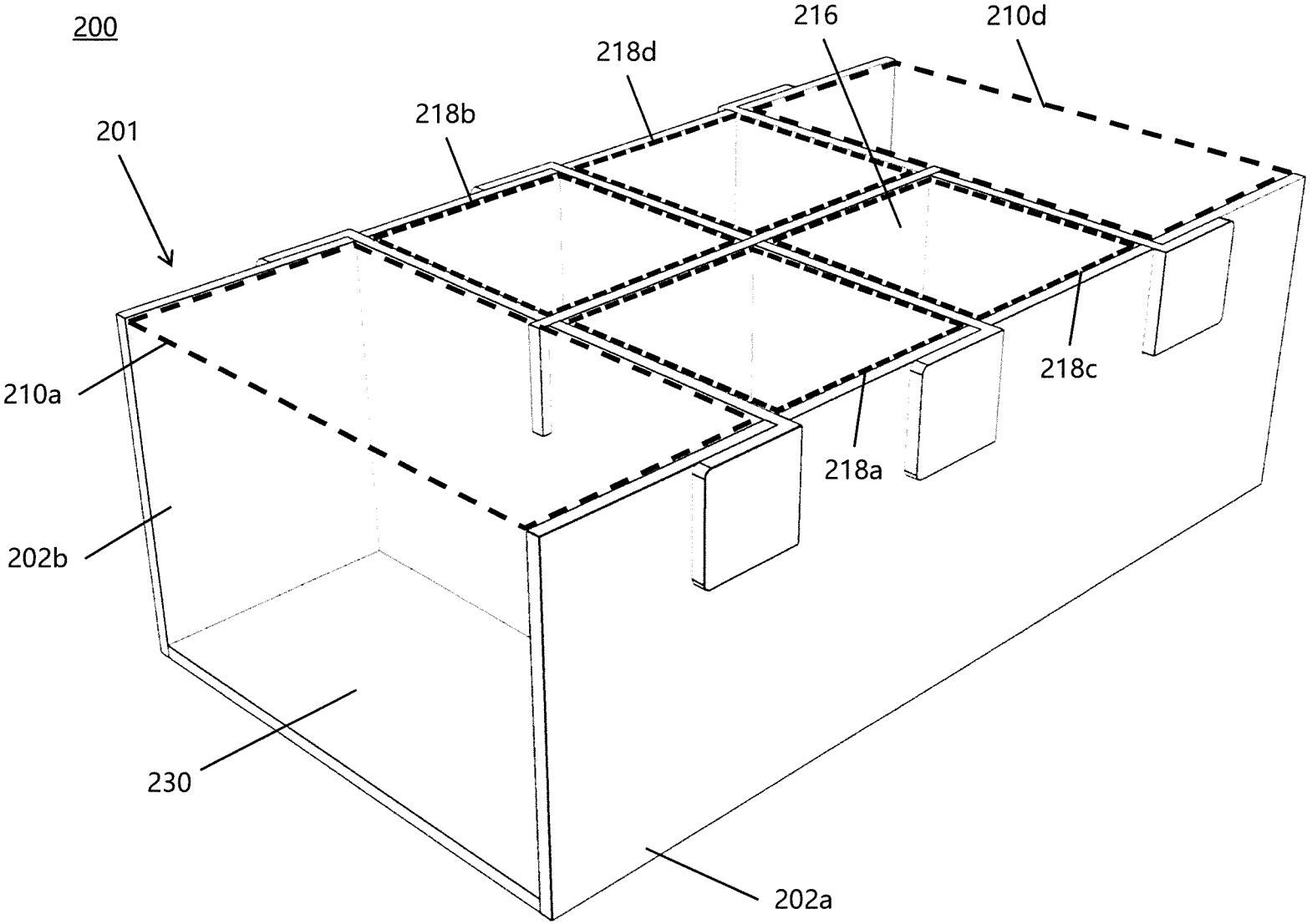

Referring now to the drawings, wherein the showings are for the purpose of illustrating non-limiting embodiments of the disclosure only and not for the purpose of limiting the same, FIG. 1 illustrates a first non-limiting embodiment of a compartment system 100. The primary components of the compartment system 100 include, but are not limited to, a divider 101, a box 124, and an optional lid 128. As illustrated in FIG. 1, the compartment system 100 is in a disassembled configuration where the divider 101, box 124, and lid 128 are separated from each other. An assembled configuration of the compartment system 100 is shown in FIGS. 8, 9 and 11 and is described in further detail below. In the assembled configuration, the divider 101 is adapted to fit within the interior area 126 of box 124, thereby separating the box into various compartments or interior regions, and the optional lid 128 is adapted to fit over the box and divider. Additional elements and features of the exemplary divider will now be described.

Figure 2:
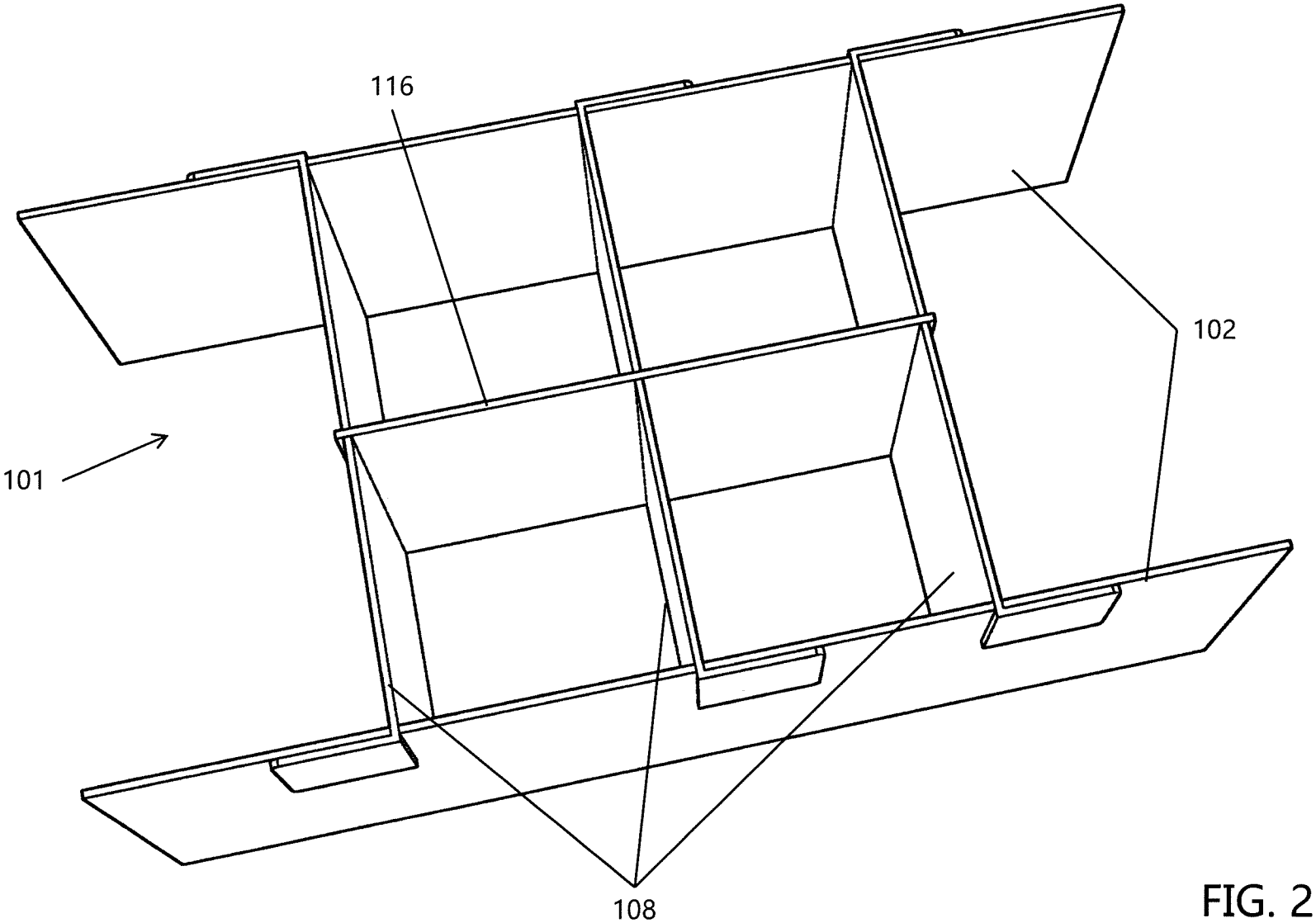
FIG. 2 is a top perspective view of the divider illustrated in FIG. 1.

With reference to FIG. 2, the divider 101 is illustrated alone to more clearly show its main components. The divider 101 generally includes one or more sidewalls 102, one or more transverse divider walls 108, and optionally one or more axial divider walls 116. The one or more transverse divider walls 108 are generally configured to separate the space between the one or more sidewalls 102 into one or more compartments. The one or more axial divider walls 116 are generally configured to separate the space between each of the one or more transverse dividers walls 108 into one or more smaller compartments.

The one or more transverse divider walls 108 are illustrated in FIG. 2 as being spaced approximately equidistant to one another along the one or more sidewalls 102. However, such a configuration is non-limiting. As such, the spacing between adjacently positioned transverse divider walls 108 can be the same or different. Moreover, the axial divider wall 116 (when used) is illustrated as bisecting the one or more transverse divider walls 108 at an approximate mid-point of the length of the one or more transverse divider walls. However, such a configuration is also non-limiting.

Additional details of the components which make up the divider 101 can be seen with reference to FIGS. 3-6. That is, the one or more sidewalls 102, one or more transverse divider walls 108, and the optional one or more axial divider walls 116 are individually illustrated in FIGS. 4, 5 and 6, respectively.

Figure 3:
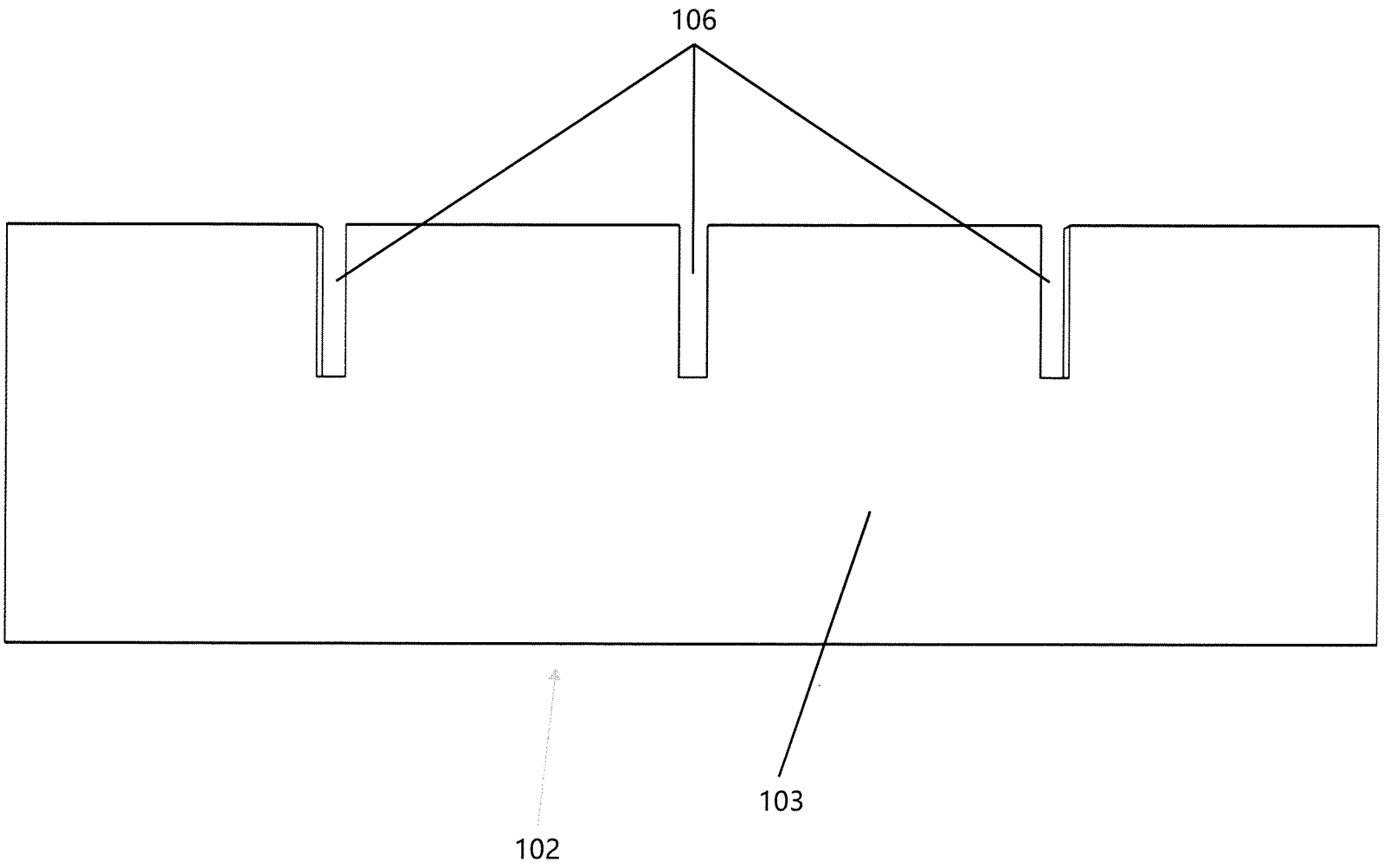
FIG. 3 is an illustration of the divider of FIG. 1 in an exploded view showing additional details of the components of the divider.
Figure 4:
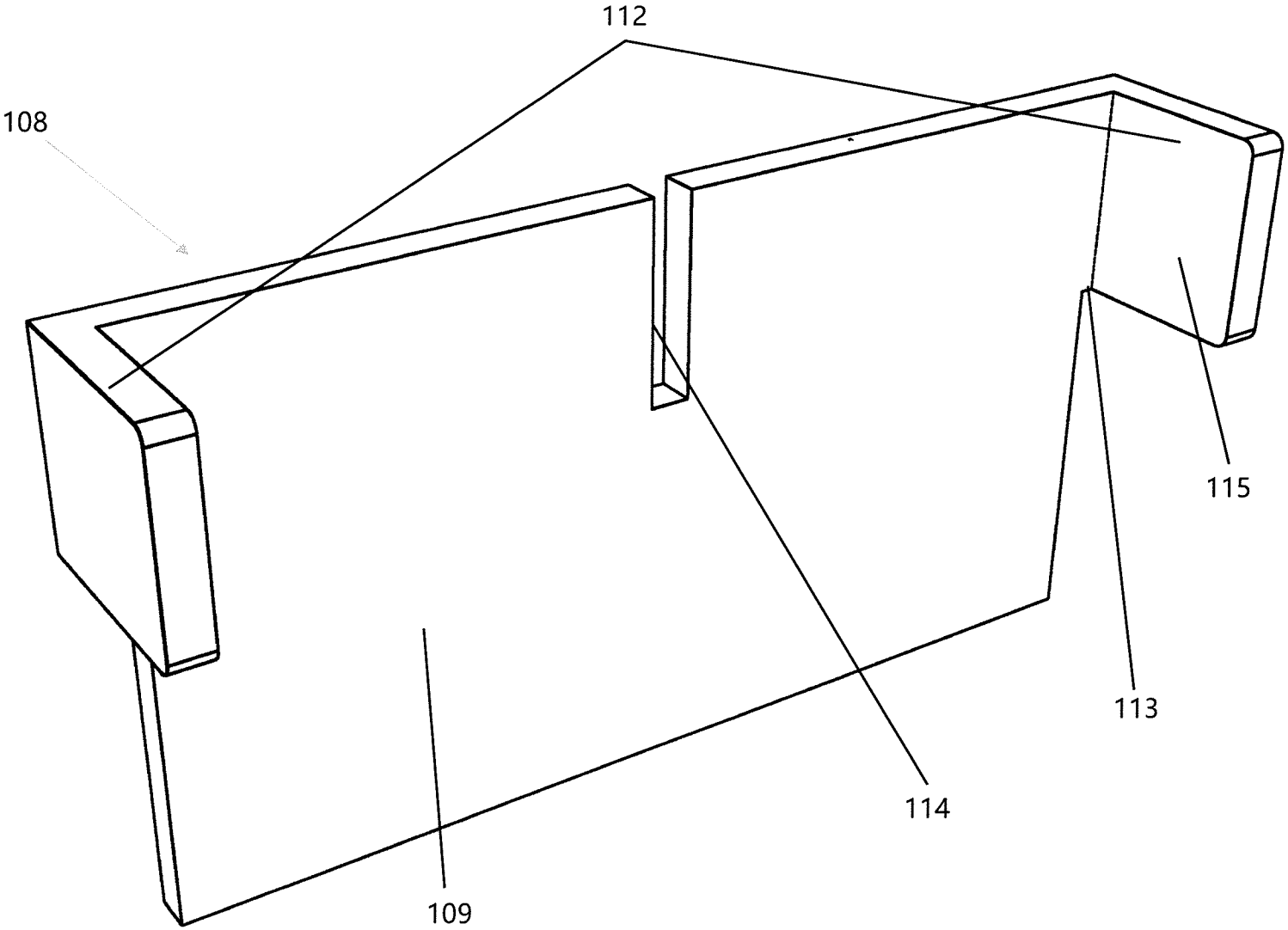
FIG. 4 is a side view of one of the sidewalls shown in the divider illustrated in FIG. 1.

As shown in FIGS. 3 and 4, the one or more sidewalls 102 each include a body 103 and one or more female connecting features or slots 106 formed on an upper edge of the body 103 of each sidewall 102. The female connecting features or slots 106 are illustrated as being spaced approximately equidistant to one another. However, such a configuration is non-limiting. The female connecting features or slots 106 are generally spaced and sized to mate with a corresponding feature on the one or more transverse divider walls 108. The size and shape of the female connecting features or slots 106 are generally the same; however, this is not required. Generally, the height or length of each of the female connecting features or slots 106 is less than 50% the height of the sidewall 102.

Figure 5:
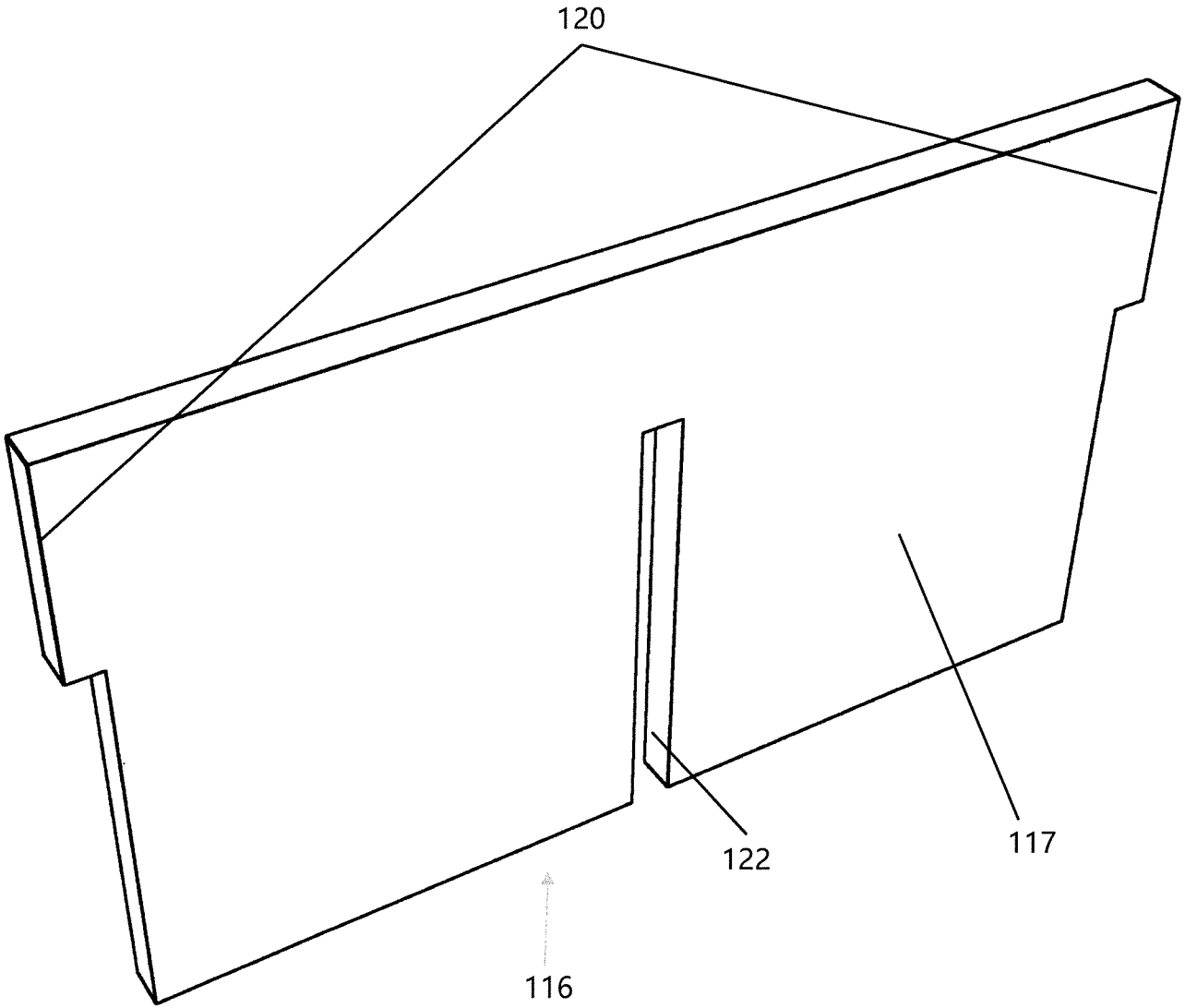
FIG. 5 is a perspective front view of one of the transverse divider walls shown in the divider illustrated in FIG. 1.

As shown in FIGS. 3 and 5, the one or more transverse divider walls 108 include one or more male connecting features or flanges 112. The one or more male connecting features or flanges are formed on an upper portion or upper edge of each side of the transverse divider walls. Each of the connecting features or flanges includes an extension portion 113 that is connected at a first side to the side of the transverse divider wall and which extension portion extends outwardly from the side of the transverse divider wall. The width of the extension portion 113 is generally within ±5% a thickness of the female connecting feature or slot 106 on a sidewall 102 (i.e., width of extension portion 113 is 95%-105% the thickness of the female connecting feature or slot). The extension portion 113 has a height (measured along a height of the transverse divider wall) that is about 5-40% a height of the transverse divider wall 108. Generally, the height of the extension portion 113 is within about ±5% of the longitudinal length of the female connecting feature or slot 106 of the sidewall 102 to which the transverse divider wall 108 is to be connected thereto.

The connecting features or flanges include a flange extension 115 that is connected to the second side of the extension portion 113. As illustrated in FIGS. 3 and 5, the width of the flange extension 115 is generally greater than a width of the extension portion 113. As illustrated in FIGS. 3 and 5, the height of the flange extension 115 is the same as the height of the extension portion 113; however, this is not required. As illustrated in FIGS. 3 and 5, the thickness of the flange extension 115 is the same as the thickness of the extension portion 113; however, this is not required.

Prior to the full assembly of the divider, the flange extension 115 can optionally lie in a plane that is parallel or non-parallel to the longitudinal axis of the transverse divider wall. In such an arrangement, the flange extension 115 is configured to be bendable at the connection location of the extension portion 113 so that the flange extension 115 can be bent until the front face of the flange extension is 80-110° (e.g., 90°) to the longitudinal axis of the body 109 of the transverse divider wall 108. Such bending can be facilitated by a groove, scoring, slots, etc. Alternatively, the flange extension 115 can be pre-oriented at an angle of about 85-95° (e.g., 90°) to the longitudinal axis of the body 109 of the transverse divider wall 108.

Figure 6:
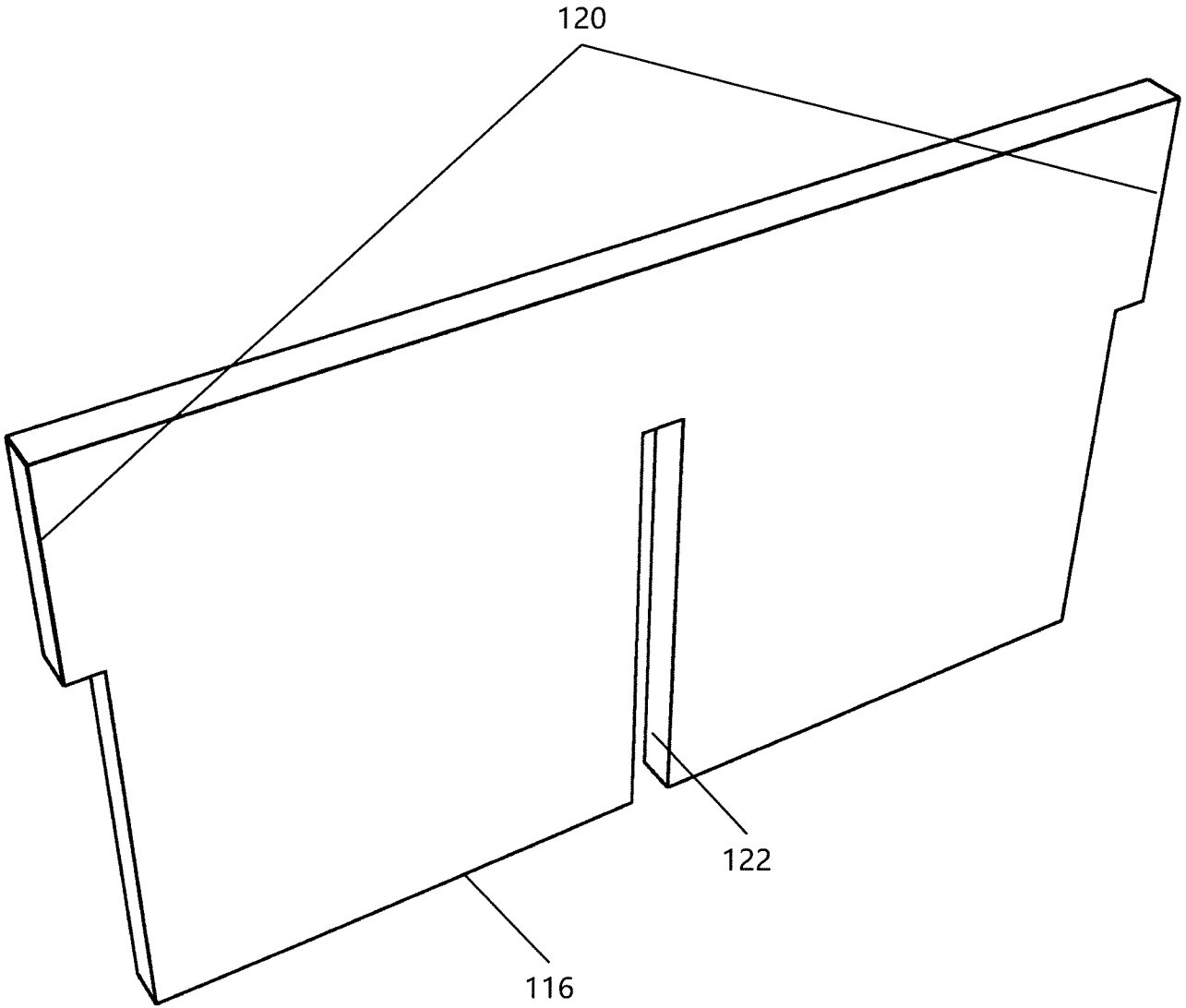
FIG. 6 is a perspective front view of the axial divider wall shown in the divider illustrated in FIG. 1.

As shown in FIG. 6, the one or more axial divider walls 116 (when used), includes a body 117 and one or more male connecting features or tabs 120 on the body 117. The male connecting features or tabs 120 are formed on an upper portion of each side of body 117 of the transverse divider walls 118 and are oriented generally parallel thereto. The tabs 120 are generally spaced and sized to mate with a corresponding female connecting features or slots 114 formed on the one or more transverse divider walls 108. Moreover, at least one female connecting feature or slot 122 is formed on a lower edge of each axial divider wall 116. The slot 122 is generally configured to mate with a corresponding feature on the one or more transverse divider walls 108.

Referring now to FIG. 3, the one or more sidewalls, one or more transverse divider walls, and optional one or more axial divider walls of the divider 101 are illustrated in an exploded view prior to being assembled and inserted into container 124 so as to more clearly show how each of these components mate or attach to one another. The one or more sidewalls include a first sidewall 102*a* and a second sidewall 102*b*. First sidewall 102*a* includes female connecting features or slots 106*a*, 106*b*, 106*c*, and second sidewall 102*b* includes female connecting features or slots 106*d*, 106*e*, 106*f*. The one or more transverse divider walls include a first end transverse divider wall 108*a*, a middle transverse divider wall 108*b*, and a second end transverse divider wall 108*c*. Transverse divider walls 108*a*, 108*b*, and 108*c* each include a pair of flanges 112*a*, 112*b*, and 112*c*, respectively. Flange pairs 112*a*, 112*b*, and 112*c* are each configured to respectively mate with corresponding pairs of slots 106*a*+106*d*, 106*b*+106*e*, and 106*c*+106*f*, on the first and second sidewalls 102*a*, 102*b*. Transverse divider walls 108*a*, 108*b*, and 108*c* each also include at least one slot 114*a*, 114*b*, 114*c*, respectively, configured to engage with a corresponding attachment feature of the axial divider wall 116. More particularly, the axial divider wall 116 includes a first side flange 120*a* configured to engage with slot 114*a* of the first end transverse divider wall 108*a*, a middle slot 122 configured to engage with slot 114*b* of the middle transverse divider wall 108*b*, and a second end flange 120*b* configured to engage with slot 114*c* of the second end transverse divider wall 108*c*. Each of the preceding connecting features mate or attach as described above to form an assembled divider, such as divider 101 illustrated in FIGS. 2 and 7, which is adapted to be placed within a corresponding box, thereby at least partially forming a system 100 of compartments suited to store various objects.

Figure 7:
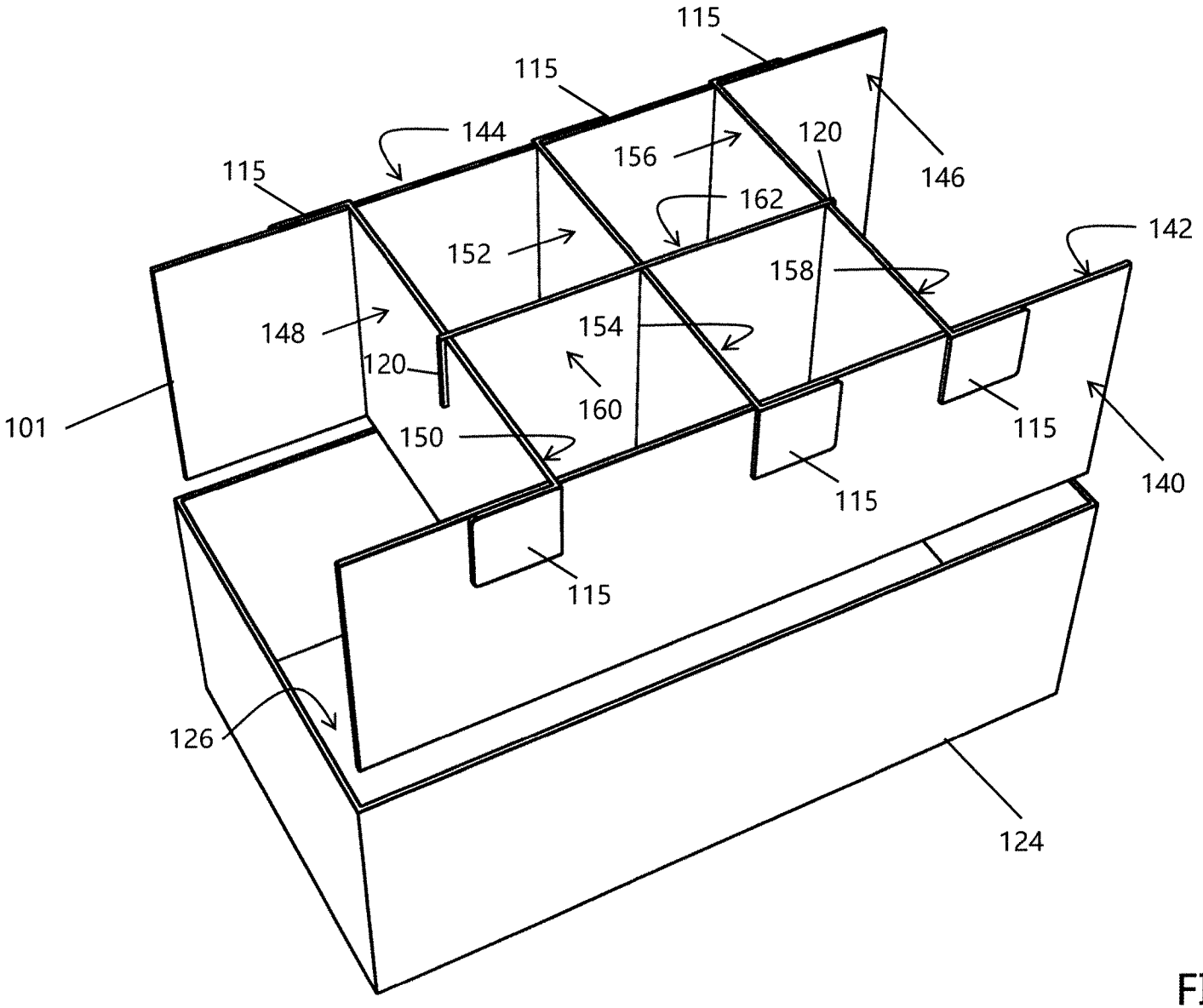
FIG. 7 is an illustration showing a top perspective view of the box and divider of FIG. 1, where the divider is positioned above the box and ready for placement therein to form an assembled configuration.

As illustrated in FIGS. 7 and 8, when the divider 101 is fully assembled, flange extensions 115 are positioned along the outer face of the sidewalls 102 and are aligned parallel with the outer face of the sidewalls 102. The male connecting features or tabs 120 are illustrated as extending beyond the transverse divider walls 108. Also, the height of the male connecting features or tabs 120 are illustrated as the longitudinal length of slot 114 in the transverse divider walls. Generally, the components of the divider 101 are configured such that after assembly, the top edge of the components all lie in the same plane or lie within ±5% of the top plane of the divider 101.

Turning to FIGS. 7-9, an exemplary divider 101 as described above and a corresponding box 124 are illustrated. In FIG. 7, the divider 101 and box 124 are about to be transformed from a dissembled configuration into an assembled configuration. That is, divider 101 is configured to be received within the corresponding box 124 and thereby form a compartment system 100 for storing various objects. The assembled configuration and the various compartments or interior regions formed by the divider 101 and within the interior area 126 of box 124 are illustrated in FIGS. 8 and 9.

With reference to FIGS. 7 and 9, the one or more sidewalls of the divider 101 create a compartment or interior region 104 which is substantially similar in size to the interior area 126 of box 124. The one or more transverse divider walls of the divider 101 are configured to separate the interior region 104/interior area 126 of box 124 into one or more transverse compartments or interior portions 110*a*, 110*b*, 110*c*, and 110*d*. The one or more axial divider walls are configured to bisect transverse compartment 110*b* into bisected sections 118*a* and 118*b* and bisect transverse compartment 110*c* into bisected sections 118*c* and 118*d*. Accordingly, a compartment system for storing various objects is formed which provides a total of six (6) interior regions or compartments, including two transverse or large compartments 110*a*, 110*d* and four bisected or small compartments 118*a*, 118*b*, 118*c*, and 118*d* that have a size that is smaller than transverse or large compartments 110*a*, 110*d*.

Described another way, the first and second sidewalls 102*a*, 102*b* each include an outer surface 140 and 144, respectively, and an inner surface 142 and 146, respectively. The area formed between outer surfaces 140, 144 is substantially similar in size to the interior area 126 of the box 124 such that the divider 101 fits entirely therein. The inner surfaces 142, 146 define the interior 104 formed between the first and second sidewalls 102*a*, 102*b*.

The first end transverse divider wall 108*a* includes a first face 148 which at least partially defines transverse compartment 110*a*. The remaining portions of transverse compartment 110*a* are defined by the inner surfaces 142, 146 of the first and second sidewalls 102*a*, 102*b* and the box 124. A second face 150 of the first end transverse divider wall 108*a* at least partially defines the transverse compartment 110*b*. A first face 152 of the middle transverse divider wall 108*b* also partially defines transverse compartment 110*b*, with the remaining portions of transverse compartment 110*b* being defined by the inner surfaces 142, 146 of the first and second sidewalls 102*a*, 102*b*. The middle transverse divider wall 108*b* further includes a second face 154 which, together with a first face 156 of the second end transverse divider wall 108*c*, at least partially defines transverse compartment 110*c*. The remaining portions of transverse compartment 110*c* are defined by the inner surfaces 142, 146 of the first and second sidewalls 102*a*, 102*b*. The second end transverse divider wall 108*c* also includes a second face 158 which at least partially defines transverse compartment 110*d*, with the remaining portions of transverse compartment 110*d* being defined by the inner surfaces 142, 146 of the first and second sidewalls 102*a*, 102*b* and the box 124.

Finally, axial divider wall 116 bisects the second face 150 of the first end transverse divider wall 108*a*, the first and second faces 152, 154 of the middle transverse divider wall 108*b*, and the first face 156 of the second end transverse divider wall 108*c*. The axial divider wall 116 includes a first face 160 and a second face 162. In this regard, bisected compartment 118*a* is formed by the first face 160 of the axial divider wall 116, the bisected faces 150, 152 of the first end and middle transverse divider walls 108*a*, 108*b*, and the inner surface 142 of the first sidewall 102*a*. Bisected compartment 118*b* is formed by the second face 162 of the axial divider wall 116, the bisected faces 150, 152 of the first end and middle transverse divider walls 108*a*, 108*b*, and the inner surface 146 of the second sidewall 102*b*. Bisected compartment 118*c* is formed by the first face 160 of the axial divider wall 116, the bisected faces 154, 156 of the middle and second end transverse divider walls 108*b*, 108*c*, and the inner surface 142 of the first sidewall 102*a*. Bisected compartment 118*d* is formed by the second face 162 of the axial divider wall 116, the bisected faces 154, 156 of the middle and second end transverse divider walls 108*b*, 108*c*, and the inner surface 146 of the second sidewall 102*b*.

As illustrated in FIG. 9, the longitudinal length of the first and second sidewalls 102*a*, 102*b* are configured to be 95-105% (e.g., 100%) the longitudinal length of the interior area 126 of box 124 such that the ends of the first and second sidewalls 102*a*, 102*b* are in contact with or a closely adjacent (e.g., less than 0.5 in.) to the inner side ends of the interior area 126 of box 124. Such a configuration of the first and second sidewalls 102*a*, 102*b* can be used to facilitate in maintaining the divider 101 in position in the interior area 126 of box 124. As also illustrated in FIG. 9, the flange extensions 115 are positioned along the outer face of the first and second sidewalls 102*a*, 102*b* so as to be located between the first and second sidewalls 102*a*, 102*b* and the interior area 126 of box 124. Such orientation of the flange extensions 115 can be used to create a friction connection between the divider 101 and the interior area 126 of box 124 so as to facilitate in maintaining the divider 101 in position in the interior area 126 of box 124.

Figure 10:
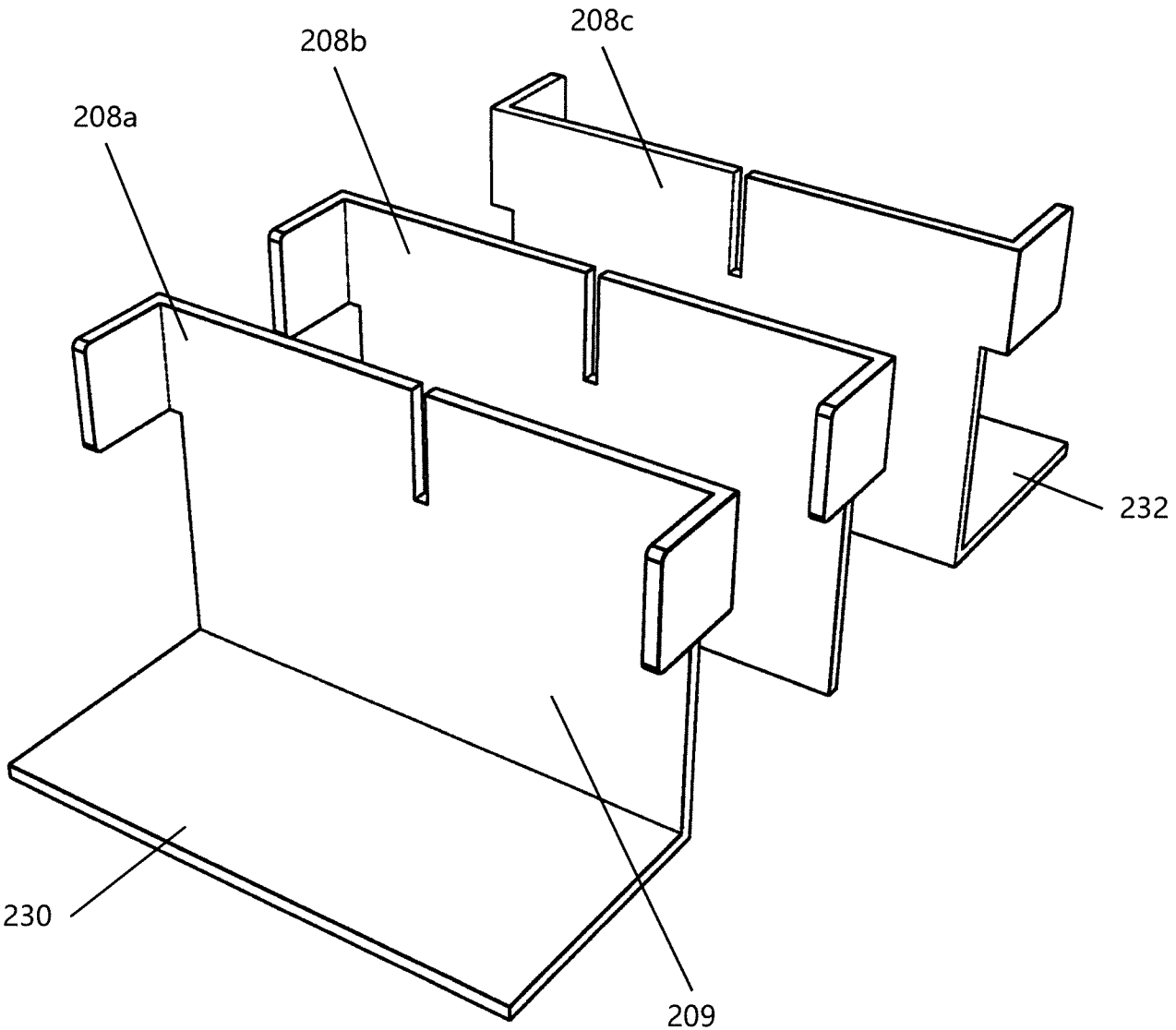
FIG. 10 is an illustration of a modification of a transverse divider wall, showing a top perspective view of one or more exemplary transverse divider walls for use in a compartment system; and, FIG. 11 is a top perspective view of the one or more exemplary transverse divider walls of FIG. 10 shown in a mated configuration with the remaining components of an exemplary divider in accordance with the present disclosure.

Referring now to FIGS. 10 and 11, there is illustrated a modification of the transverse divider walls that can be used. The primary components of the compartment system 200 are substantially identical to the primary components of the compartment system 100; thus, the configuration, assembly, and advantages described above regarding compartment system 100 that also exist in compartment system 200 will not be fully repeated herein with regard to compartment system 200.

Compartment system 200 generally includes a divider 201 adapted to fit within a box, such as box 124 illustrated in FIG. 1, and which box can optionally be used with a lid, such as lid 128 illustrated in FIG. 1. Moreover, divider 201 includes components substantially identical to those of divider 101 discussed above and shown in at least FIG. 2. However, divider 201 is different from divider 101 in that the transverse divider walls 208 include an additional feature not provided on transverse divider walls 108.

As illustrated in FIG. 10, the first and second end transverse divider walls 208*a* and 208*c* of divider 201 include at least one floor portion 230 and 232 on the bottom of the body 209 of the divider wall, respectively. The at least one floor portion 230, 232 is generally formed on a lower edge of the body 209 of the first and second end transverse divider walls 208*a*, 208*c* and are oriented generally perpendicular thereto. As such, floor portions 230, 232 generally extend along an axis parallel to that of the bottom wall of a corresponding box, with floor portions 230, 232 extending in opposing directions along this parallel axis. As shown in FIG. 11, floor portion 230, floor portion 232 (not shown in FIG. 11), and the first and second sidewalls 202*a*, 202*b* generally terminate in a colinear manner and at a location generally adjacent to the ends of a corresponding box.

Similar to divider 101 described above, the one or more sidewalls 202*a*, 202*b*, one or more transverse divider walls 208*a*, 208*b*, 208*c*, and one or more axial divider walls 216 form a total of six (6) interior regions or compartments, including two transverse or large compartments 210*a*, 210*d* and four bisected or small compartments 218*a*, 218*b*, 218*c*, and 218*d*. However, in divider 201, the floor portions 230 and 232 of the first and second end transverse divider walls provide additional strength and support to the bottom of transverse compartments 210*a* and 210*d*. Since transverse compartments 210*a* and 210*d* are larger than bisected compartments 218*a*, 218*b*, 218*c*, and 218*d*, it is likely that a user may prefer to store bigger, heavier objects, or a larger number of objects, in the larger transverse compartments. In this regard, the floor portions 230 and 232 are configured to provide the larger transverse compartments 210*a* and 210*d* with the additional strength and support needed to accommodate and safely store such bigger, heavier, or larger number of objects.

Moreover, one or more floor portions, such as floor portions 230, 232, may be desired to provide additional stability to the divider 201. Dividers that are configured to fit within large or oversized boxes, for example, may be more prone to flexing or shifting, compared with smaller dividers and boxes, especially during assembly of the divider itself or when various objects are being placed within a box and divider in the assembled configuration. In this regard, one or more floor portions, such as floor portions 230, 232, are configured to provide the additional stability and support needed for larger dividers and boxes and for the safe storing of various objects therein.

Furthermore, it should be understood that the location of any exemplary floor portion, such as floor portions 230, 232 described above, is non-limiting. That is, while floor portions 230, 232 are illustrated as being formed on one side of the first and second end transverse divider walls 208*a* and

208*c*, such an arrangement is only exemplary and additional floor portions may be formed at additional locations as desired without departing from the scope of the present disclosure. For example, one, some, or all of compartments 210*a*, 210*d*, and 218*a*-218*d* may be provided with a floor portion formed on any one of transverse divider walls 208*a*-208*c* or axial divider wall 216. In this regard, the location of the one or more floor portions may depend on, for example, the divider and box size or the type of objects that are to be stored within the box formed by the divider.

The compartment systems described herein, including the exemplary dividers, boxes, and lids which make up such compartment systems, can be made from any desired material, the particular material used being non-limiting. For example, the presently disclosed compartment systems and components associated therewith can be made from materials such as paper, cardboard, plastic, thermoplastic, polymer, rubber, metal, wood, etc., and combinations thereof, without departing from the scope of the present disclosure.

Furthermore, any number of methods may be used to form the compartment systems and dividers of the present disclosure. In one non-limiting example, the components of the dividers described herein can be manufactured and provided as preformed components. Such preformed components could be manufactured at the requisite size and with the requisite connecting features (e.g., the male and female connecting features described above) such that a divider can be assembled which fits within boxes of a predetermined size. Injection molding, for example, could be used to form such preformed components.

In another non-limiting example, partially complete elements (not shown) are provided which can be subsequently manipulated to form each component of a divider, including one or more sidewalls, transverse divider walls, and axial divider sidewalls as described above. The partially complete elements can be substantially flat sheet or board-like materials which include one or more score, crease, or cut lines. The score, crease, or cut lines indicate how each partially complete element should be manipulated to form fully complete divider components and features. For example, cut lines are provided to indicate where female connecting features should be formed (such as slots 106*a*-106*f* in sidewalls 102*a*, 102*b*, slots 114*a*-114*b* in transverse divider walls 108*a*-108*c*, and/or slot 122 in axial divider wall 116). Score or crease lines are provided to indicate where folds should be made to form male connecting features (such as flange pairs 112*a*-112*c* on transverse divider walls 108*a*-108*c*).

Moreover, in other non-limiting embodiments, multiple score, crease, or cut lines can be provided at every location where a connecting or dividing feature is to be formed. As such, final components can be constructed that enable the assembly of an adaptable divider which can, depending on the particular score, crease, or cut lines used: (a) fit within a range of box sizes; (b) form varying arrangements of storage compartments; and/or, (c) form varying sizes of storage compartments.

Even though the exemplary compartment systems and dividers associated therewith may be particularly suitable to the organization and storing of specific items and objects such as, for example, school-related materials like pens, pencils, erasers, scissors, staples, staplers, crayons, markers, etc., it should be understood that any desired item can be stored without departing from the scope of the present disclosure. Moreover, the dimensions of the exemplary compartment systems and dividers associated therewith are non-limiting. It should be clear from a reading of the present disclosure that the exemplary compartment systems and associated dividers can be sized to any desired dimension without departing from the scope of the embodiments discussed herein.

While considerable emphasis has been placed herein on the structures and configurations of the preferred embodiments of the disclosure, it will be appreciated that other embodiments, as well as modifications of the embodiments disclosed herein, can be made without departing from the principles of the disclosure. These and other modifications of the preferred embodiments, as well as other embodiments of the disclosure, will be obvious and suggested to those skilled in the art from the disclosure herein, whereby it is to be distinctly understood that the foregoing descriptive matter is to be interpreted merely as illustrative of the present disclosure and not as a limitation thereof.

What is claimed:

1. A compartment system including a box or container, and a divider, said divider configured to fit within an interior area of said box or container and to form a plurality of compartments in said interior area of said box or container, said divider includes first and second sidewalls, and a first transverse divider wall that is connected to said first and second sidewalls, each of said first and second sidewalls includes a body having a first slot formed on an upper edge of said body of each of said first and second sidewalls, said body of each of said first and second sidewalls having a front and back face, said first slot on said body of each of said first and second sidewalls spaced from an end of said body of said first and second sidewalls, said first slot on said body of each of said first and second sidewalls formed in said front and back faces of said body, said first transverse divider wall includes a body having first and second male flanges, said body of said first transverse divider wall having a front and back face, each of said first and second male flanges formed on an upper portion of said body of said first transverse divider wall, said first male flange includes a first extension portion and a first flange extension, one side of said first extension portion connected to a first side of said body of said first transverse divider wall, said first flange extension connected to an opposite side of said first extension portion, said first extension portion extending outwardly from said body of said first transverse divider wall, said first flange extension extending outwardly from said first extension portion, said second male flange includes a second extension portion and a second flange extension, one side of said second extension portion connected to a second side of said body of said first transverse divider wall, said second flange extension connected to an opposite side of said second extension portion, said second extension portion extending outwardly from said body of said first transverse divider wall, said second flange extension extending outwardly from said second extension portion, said first extension portion of said first male flange positioned in and fully extending through said first slot of body of said first sidewall, said first flange extension at least partially overlying a portion of said back face of said body of said first sidewall, said first flange extension forming an angle of 80-110° to said first extension portion, a majority of said first flange extension positioned below a top edge of said first sidewall, said second extension portion of said second male flange positioned in and fully extending through said first slot of body of said second sidewall, said second flange extension at least partially overlying a portion of said back face of said body of said second sidewall, said second flange extension forming an angle of 80-110° to said second extension portion, a majority of said second flange extension positioned below a top edge of said first sidewall, said body of said first transverse divider wall positioned between said front face of said body of said first and second sidewalls, said first flange extension is bendable from a position wherein said first extension flange is parallel to said first extension portion to a position wherein said first extension flange at an angle of 80-110° to said first extension portion so as to facilitate in securing said first transverse divider wall to said first sidewall, said second flange extension is bendable from a position wherein said second extension flange is parallel to said second extension portion to a position wherein said second extension flange at an angle of 80-110° to said second extension portion so as to facilitate in securing said second transverse divider wall to said second sidewall.

2. The compartment system as defined in claim 1, wherein said first slot on said body of each of said first and second sidewalls has a longitudinal length that is no more than 50% a height of said body of said first and second sidewalls.

3. The compartment system as defined in claim 1, wherein said first transverse divider wall includes a first floor portion connected to a lower edge of said body of said first transverse divider wall, said first floor portion lying in a plane that is 80-120° to a plane of said body of said first transverse divider wall.

4. The compartment system as defined in claim 3, wherein a longitudinal length of said first floor portion is greater than a longitudinal length of said first extension portion.

5. The compartment system as defined in claim 1, wherein said divider further includes a second transverse divider wall, said first and second transverse divider walls having a same size, shape and configuration, said second transverse divider wall connected to said first and second sidewalls.

6. The compartment system as defined in claim 5, wherein said divider further includes a first axial divider wall that is connected to said first and second transverse divider walls, said first axial divider wall having a body that includes a slot and a first tab, said body having a front and back face, said slot spaced from the sidewalls of said body of said first axial divider wall, said slot formed on a lower edge of said body of said first axial divider wall and said slot formed in said front and back faces of said body of said first axial divider wall, said tab formed on an upper edge of said body of said first axial divider wall and extending outwardly from a first side of said body of said first axial divider wall, said slot engaging and receiving a portion of said body of said second transverse divider wall, said tab inserted into a slot in said body of said first transverse divider wall, said slot in said body of said first transverse divider wall spaced from the sidewalls of said body of said first transverse divider wall, said slot formed on an upper edge of said body of said first transverse divider wall.

7. The compartment system as defined in claim 6, wherein said first end of said body of said first axial divider wall faces said front face of said body of said first transverse divider wall and said tab extends outwardly from said rear face of said body of said first transverse divider wall.

8. The compartment system as defined in claim 6, wherein a height of said slot in said body of said first axial divider wall is greater than 50% than a height of said body of said first axial divider wall.

9. The compartment system as defined in claim 6, wherein a body of said second transverse divider wall includes a slot spaced from sidewalls of said body of said second transverse divider wall, said slot formed on an upper edge of said body of said second transverse divider wall and said slot formed in front and back faces of said body of said second transverse divider wall, said slot on said body of said second transverse divider wall engaging and receiving a portion of said body of said first axial divider wall.

10. The compartment system as defined in claim 1, wherein a majority of said first extension portion of said first male flange is positioned in said first slot of body of said first sidewall, a majority of said second extension portion of said second male flange is positioned in said first slot of body of said second sidewall.

11. A compartment system including a box or container, and a divider, said divider configured to fit within an interior area of said box or container and to form a plurality of compartments in said interior area of said box or container, said divider includes first and second sidewalls, and a first transverse divider wall that is connected to said first and second sidewalls, each of said first and second sidewalls includes a body having a first slot formed on an upper edge of said body of each of said first and second sidewalls, said body of each of said first and second sidewalls having a front and back face, said first slot on said body of each of said first and second sidewalls spaced from an end of said body of said first and second sidewalls, said first slot on said body of each of said first and second sidewalls formed in said front and back faces of said body, said first transverse divider wall includes a body having first and second male flanges, said body of said first transverse divider wall having a front and back face, each of said first and second male flanges formed on an upper portion of said body of said first transverse divider wall, said first male flange includes a first extension portion and a first flange extension, one side of said first extension portion connected to a first side of said body of said first transverse divider wall, said first flange extension connected to an opposite side of said first extension portion, said first extension portion extending outwardly from said body of said first transverse divider wall, said first flange extension extending outwardly from said first extension portion, said second male flange includes a second extension portion and a second flange extension, one side of said second extension portion connected to a second side of said body of said first transverse divider wall, said second flange extension connected to an opposite side of said second extension portion, said second extension portion extending outwardly from said body of said first transverse divider wall, said second flange extension extending outwardly from said second extension portion, said first extension portion of said first male flange positioned in and fully extending through said first slot of body of said first sidewall, said first flange extension at least partially overlying a portion of said back face of said body of said first sidewall, said first flange extension forming an angle of 80-110° to said first extension portion, a majority of said first flange extension positioned below a top edge of said first sidewall, said second extension portion of said second male flange positioned in and fully extending through said first slot of body of said second sidewall, said second flange extension at least partially overlying a portion of said back face of said body of said second sidewall, said second flange extension forming an angle of 80-110° to said second extension portion, a majority of said second flange extension positioned below a top edge of said first sidewall, said body of said first transverse divider wall positioned between said front face of said body of said first and second sidewalls, said first flange extension is bendable from a position wherein said first extension flange is parallel to said first extension portion to a position wherein said first extension flange at an angle of 80-110° to said first extension portion so as to facilitate in securing said first transverse divider wall to said first sidewall, said second flange extension is bendable from a position wherein said second extension flange is parallel to said second extension portion to a position wherein said second extension flange at an angle of 80-110° to said second extension portion so as to facilitate in securing said second transverse divider wall to said second sidewall, a majority of said second extension portion of said second male flange is positioned in said first slot of body of said second sidewall, said first slot on said body of each of said first and second sidewalls has a longitudinal length that is no more than 50% a height of said body of said first and second sidewalls.

12. The compartment system as defined in claim 3, wherein said first transverse divider wall includes a first floor portion connected to a lower edge of said body of said first transverse divider wall, said first floor portion lying in a plane that is 80-120° to a plane of said body of said first transverse divider wall, a longitudinal length of said first floor portion is greater than a longitudinal length of said first extension portion.

13. A method of forming a compartment system, comprising:

providing a box or container having an interior area;

providing a divider that is configured to be inserted into said interior area of said box or container, said divider includes first and second sidewalls, and a first transverse divider wall that is connected to said first and second sidewalls, each of said first and second sidewalls includes a body having a first slot formed on an upper edge of said body of each of said first and second sidewalls, said body of each of said first and second sidewalls having a front and back face, said first slot on said body of each of said first and second sidewalls spaced from an end of said body of said first and second sidewalls, said first slot on said body of each of said first and second sidewalls formed in said front and back faces of said body, said first transverse divider wall includes a body having first and second male flanges, said body of said first transverse divider wall having a front and back face, each of said first and second male flanges formed on an upper portion of said body of said first transverse divider wall, said first male flange includes a first extension portion and a first flange extension, one side of said first extension portion connected to a first side of said body of said first transverse divider wall, said first flange extension connected to an opposite side of said first extension portion, said first extension portion extending outwardly from said body of said first transverse divider wall, said first flange extension extending outwardly from said first extension portion, said second male flange includes a second extension portion and a second flange extension, one side of said second extension portion connected to a second side of said body of said first transverse divider wall, said second flange extension connected to an opposite side of said second extension portion, said second extension portion extending outwardly from said body of said first transverse divider wall, said second flange extension extending outwardly from said second extension portion, said first extension portion of said first male flange positioned in and fully extending through said first slot of body of said first sidewall, said first flange extension at least partially overlying a portion of said back face of said body of said first sidewall, said first flange extension forming an angle of 80-110° to said first extension portion, a majority of said first flange extension positioned below a top edge of said first sidewall, said second extension portion of said second male flange positioned in and fully extending through said first slot of body of said second sidewall, said second flange extension at least partially overlying a portion of said back face of said body of said second sidewall, said second flange extension forming an angle of 80-110° to said second extension portion, a majority of said second flange extension positioned below a top edge of said first sidewall, said body of said first transverse divider wall positioned between said front face of said body of said first and second sidewalls, said first flange extension is bendable from a position wherein said first extension flange is parallel to said first extension portion to a position wherein said first extension flange at an angle of 80-110° to said first extension portion, said second flange extension is bendable from a position wherein said second extension flange is parallel to said second extension portion to a position wherein said second extension flange at an angle of 80-110° to said second extension portion, and further including the step of bending said first and second extension flanges to secure said first transverse divider wall to said first and second sidewalls; and, placing said divider into said interior area of said box or container.

14. The method as defined in claim 13, wherein said first transverse divider wall includes a first floor portion connected to a lower edge of said body of said first transverse divider wall, said first floor portion lying in a plane that is 80-120° to a plane of said body of said first transverse divider wall, a longitudinal length of said first floor portion is greater than a longitudinal length of said first extension portion, and further including the step of bending said first floor portion prior to fully placing said divider into said interior area of said box or container.

15. A method of forming a compartment system, comprising:

providing a box or container having an interior area;

providing a divider that is configured to be inserted into said interior area of said box or container, said divider includes first and second sidewalls, and a first transverse divider wall that is connected to said first and second sidewalls, each of said first and second sidewalls includes a body having a first slot formed on an upper edge of said body of each of said first and second sidewalls, said body of each of said first and second sidewalls having a front and back face, said first slot on said body of each of said first and second sidewalls spaced from an end of said body of said first and second sidewalls, said first slot on said body of each of said first and second sidewalls formed in said front and back faces of said body, said first transverse divider wall includes a body having first and second male flanges, said body of said first transverse divider wall having a front and back face, each of said first and second male flanges formed on an upper portion of said body of said first transverse divider wall, said first male flange includes a first extension portion and a first flange extension, one side of said first extension portion connected to a first side of said body of said first transverse divider wall, said first flange extension connected to an opposite side of said first extension portion, said first extension portion extending outwardly from said body of said first transverse divider wall, said first flange extension extending outwardly from said first extension portion, said second male flange includes a second extension portion and a second flange extension, one side of said second extension portion connected to a second side of said body of said first transverse divider wall, said second flange extension connected to an opposite side of said second extension portion, said second extension portion extending outwardly from said body of said first transverse divider wall, said second flange extension extending outwardly from said second extension portion, said first extension portion of said first male flange positioned in and fully extending through said first slot of body of said first sidewall, said first flange extension at least partially overlying a portion of said back face of said body of said first sidewall, said first flange extension forming an angle of 80-110° to said first extension portion, a majority of said first flange extension positioned below a top edge of said first sidewall, said second extension portion of said second male flange positioned in and fully extending through said first slot of body of said second sidewall, said second flange extension at least partially overlying a portion of said back face of said body of said second sidewall, said second flange extension forming an angle of 80-110° to said second extension portion, a majority of said second flange extension positioned below a top edge of said first sidewall, said body of said first transverse divider wall positioned between said front face of said body of said first and second sidewalls, said first flange extension is bendable from a position wherein said first extension flange is parallel to said first extension portion to a position wherein said first extension flange at an angle of 80-110° to said first extension portion so as to facilitate in securing said first transverse divider wall to said first sidewall, said second flange extension is bendable from a position wherein said second extension flange is parallel to said second extension portion to a position wherein said second extension flange at an angle of 80-110° to said second extension portion so as to facilitate in securing said second transverse divider wall to said second sidewall, a majority of said first extension portion of said first male flange is positioned in said first slot of body of said first sidewall, a majority of said second extension portion of said second male flange is positioned in said first slot of body of said second sidewall, said first slot on said body of each of said first and second sidewalls has a longitudinal length that is no more than 50% a height of said body of said first and second sidewalls; and, placing said divider into said interior area of said box or container.

16. The method as defined in claim 15, wherein said first transverse divider wall includes a first floor portion connected to a lower edge of said body of said first transverse divider wall, said first floor portion lying in a plane that is 80-120° to a plane of said body of said first transverse divider wall, a longitudinal length of said first floor portion is greater than a longitudinal length of said first extension portion, and further including the step of bending said first floor portion prior to fully placing said divider into said interior area of said box or container.

* * * * *